US009222327B2

(12) United States Patent
Humphreys

(10) Patent No.: US 9,222,327 B2
(45) Date of Patent: Dec. 29, 2015

(54) WELL SAFETY EQUIPMENT

(71) Applicant: Stena Drilling Ltd., Aberdeen (GB)

(72) Inventor: Gavin Humphreys, Aberdeen (GB)

(73) Assignee: STENA DRILLING LTD., Aberdeen (GB)

( * ) Notice: Subject to any disclaimer, the term of this patent is extended or adjusted under 35 U.S.C. 154(b) by 114 days.

(21) Appl. No.: 13/687,080

(22) Filed: Nov. 28, 2012

(65) Prior Publication Data

US 2014/0144646 A1 May 29, 2014

(51) Int. Cl.

| | |
|---|---|
| ***E21B 33/038*** | (2006.01) |
| ***E21B 33/064*** | (2006.01) |
| ***E21B 41/00*** | (2006.01) |
| ***E21B 43/01*** | (2006.01) |

(52) U.S. Cl.

CPC ..... *E21B 33/064* (2013.01); *E21B 33/038* (2013.01); *E21B 41/0014* (2013.01); *E21B 43/0122* (2013.01)

(58) Field of Classification Search

CPC .. E21B 19/004; E21B 33/038; E21B 43/0122
USPC ..... 166/340, 351, 363, 365, 368, 75.13; 405/224.2
See application file for complete search history.

(56) References Cited

U.S. PATENT DOCUMENTS

| | | | | |
|---|---|---|---|---|
| 3,688,840 | A * | 9/1972 | Curington et al. | 166/341 |
| 3,913,668 | A * | 10/1975 | Todd et al. | 166/359 |
| 4,461,354 | A * | 7/1984 | Buras et al. | 166/343 |
| 5,676,209 | A * | 10/1997 | Reynolds | 166/345 |
| 7,578,349 | B2 * | 8/2009 | Sundararajan et al. | 166/363 |
| 8,434,558 | B2 * | 5/2013 | Swanson et al. | 166/368 |
| 8,714,263 | B2 * | 5/2014 | Sundararajan et al. | 166/348 |
| 8,720,580 | B1 * | 5/2014 | Lugo | 166/344 |
| 2011/0247827 | A1 * | 10/2011 | Humphreys | 166/345 |
| 2011/0284237 | A1 * | 11/2011 | Baugh | 166/365 |
| 2012/0048566 | A1 * | 3/2012 | Coppedge et al. | 166/340 |
| 2012/0067589 | A1 * | 3/2012 | Fenton | 166/340 |
| 2012/0085543 | A1 * | 4/2012 | Redden et al. | 166/339 |
| 2013/0020086 | A1 * | 1/2013 | Anderson et al. | 166/339 |
| 2013/0032351 | A1 * | 2/2013 | Smith | 166/339 |
| 2013/0140035 | A1 * | 6/2013 | Smith et al. | 166/345 |
| 2013/0299177 | A1 * | 11/2013 | Lyle | 166/338 |

FOREIGN PATENT DOCUMENTS

| | | | |
|---|---|---|---|
| WO | 2012099841 | A2 | 7/2012 |
| WO | 2012140178 | A1 | 10/2012 |
| WO | 2012142274 | A2 | 10/2012 |

OTHER PUBLICATIONS

International Search Report and Written Opinion dated Jun. 10, 2015 issued in PCT/1B2013003132 (14 pages).

Wells, K., "BP Macondo MC 252 well capping operations: sealing cap installation presentations," dated Jul. 7, 2010, Retrieved from the Internet: http://www.bpcom/en/global/corporate.gulf-of-mexico-restoration/deepwater-horizon-accident-and-response/containing-the-leak.html dated Jul. 7, 2010 (55 pages).

* cited by examiner

*Primary Examiner* — Matthew Buck
(74) *Attorney, Agent, or Firm* — Trop, Pruner & Hu, P.C.

(57) ABSTRACT

An independently operable disconnect device remotely disconnectable from an LMRP to reveal a riser profile compatible with a capping device connecter. A capping device including a capping device connector to be coupled to said riser profile. The capping device includes at least one blowout preventer operable to stop the overflow of petroleum products from a well. Thus, a drilling marine riser may be fully disconnected from an LMRP in an emergency. Then the well may be subsequently capped.

5 Claims, 2 Drawing Sheets

WELL SAFETY EQUIPMENT

BACKGROUND

This relates to drilling wells in deep water and particularly to equipment for improving the safety of workers on offshore drilling platforms. As used herein, an offshore platform includes any device for drilling in water.

Drilling in deep water can be a reasonably dangerous activity. When systems fail, workers can be exposed to the risk of fire and explosion.

In the Macondo disaster in the Gulf of Mexico, conventional systems failed. The workers on the platform were then tethered to the well and when the well exploded, many were injured and killed.

BRIEF DESCRIPTION OF THE DRAWINGS

Some embodiments are described with respect to the following figures.

DETAILED DESCRIPTION

In accordance with some embodiments, a tool is provided to implement a severable connection, between riser pipe and a well, for use in emergency situations. Particularly in cases like the Macondo well disaster, where blow-out preventers and shear devices fail, it would be desirable to enable the drilling platform to be separated from the wellhead for the safety of the workers. Otherwise, the workers are effectively tied to the dangerous wellhead, under situations when blow-out preventers and other safety devices have already failed.

In some embodiments, the severing system may be operated completely independently of those hydraulic and electrical systems responsible for operating shear devices and blow-out preventers, which under the circumstances contemplated here, may have failed. Then, because the connection between the riser and the wellhead and the connection between the mux lines and the wellhead may be severed, from a remote location, it is possible to separate the drilling platform from a wellhead. This disconnection allows the drilling platform to move away from the wellhead, possibly reducing injuries and loss of life in some cases.

Figure 1:
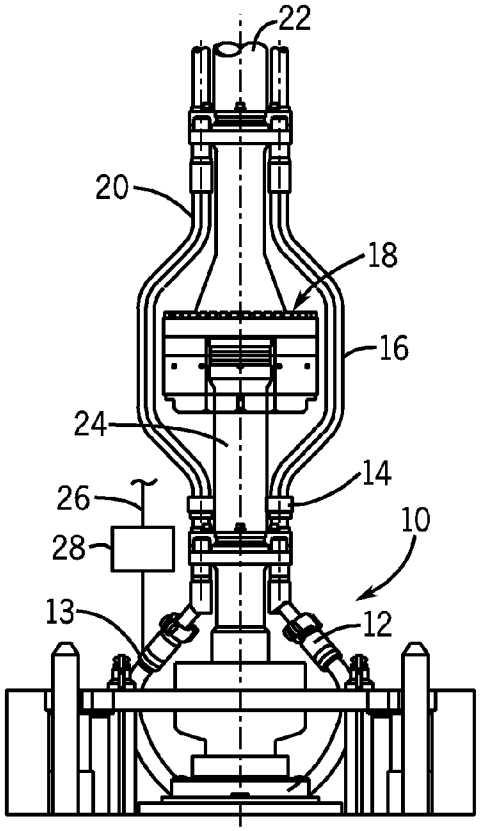
FIG. 1 is a partial cross-sectional view of one embodiment of the present invention in place.

In FIG. 1, the lower portion of a riser 22 is shown in position on top of the independent riser disconnect device with the bottom of the device connected to the Lower Marine Riser Package (LMRP) 10. Kill and choke flexible lines 12 go from the top of the LMRP to the mini connectors that connect the kill and choke lines to the kill and choke lines on the Subsea blowout preventer (BOP) below. The device 20 (between riser joint 22 and LMRP 10) is a controlled riser disconnect device that enables a riser to be severed from the wellhead in case of emergency when other components, such as a blow-out preventer or LMRP, have failed allowing the well to continue to flow. Once the connection has been released, in some embodiments, a free flow of petroleum products may result. While this will create the potential environmental hazards, it would improve the likelihood of survival for crew members on the offshore drilling platform in some cases but also provide a male wellhead profile where a BOP or capping device can be installed to stem the flow of petroleum products.

Particularly, kill and choke line mini-connectors 14 connect the lower portion of the kill and choke flexible lines 12 to the upper portion 16. The connectors 14 may be any kind of independently un-lockable connector that is synchronized to disconnect when main connector 18 disconnects. When the main connector 18 is disconnected, the mini-connectors unlock and disconnect at the same time as the main connector, allowing the upper and lower sections to disconnect together.

In some embodiments, the wellhead connector 18 may be an 18-¾" wellhead connector. The lower part or stub 24 of the device then is left in place connected to the LMRP 10 as shown in FIG. 2 and may be used by a capping device (not shown in FIG. 1) to subsequently cap off the free flowing petroleum products.

Figure 2:
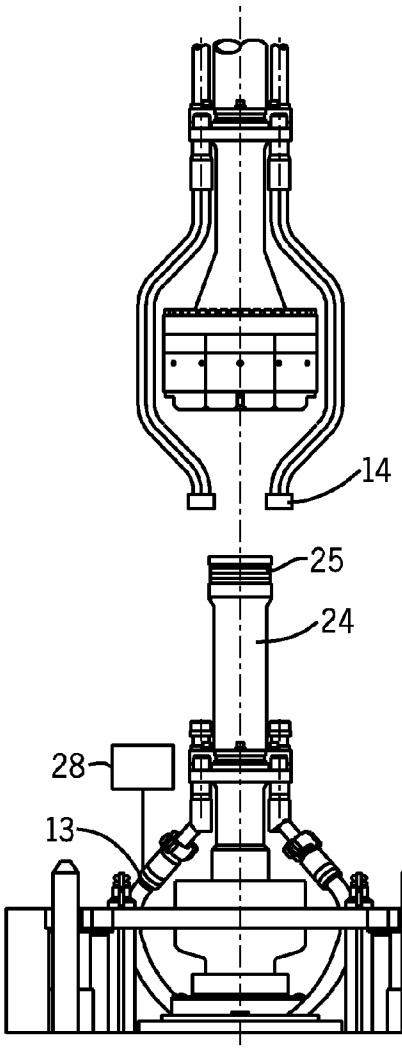
FIG. 2 is a partial depiction of the embodiment of FIG. 1 after well disconnection according to one embodiment.

Thus, as shown in FIG. 2, a riser stub 24 extends upwardly to ribbed wellhead connector 25. A MUX cable quick disconnect 28 is left coupled to the line 13 and to control line 26 that goes to the drilling platform (not shown). Petroleum products may free flow as the result of the removal of the disconnect device 20.

Figure 3:
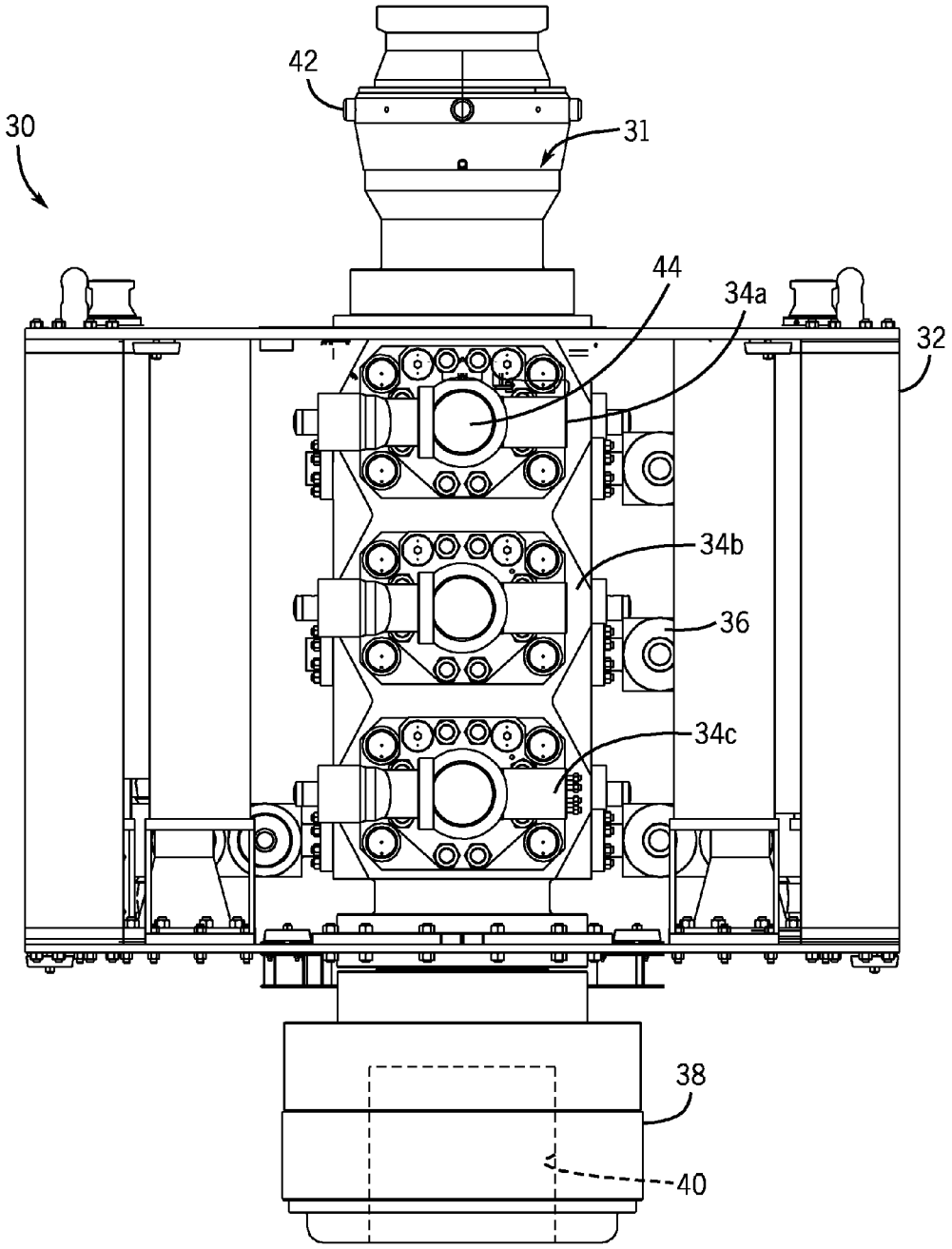
FIG. 3 is a side elevation view of a well cap according to one embodiment.

Then, referring to FIG. 3, the drilling platform may place a capping device 30 on the wellhead attached to the stub 24. This may be done using drill pipe or a crane with a remotely operated vehicle (ROV) locking the capping device to profile 25 in one embodiment.

Thus in FIG. 3, a running tool 31 includes running tool connection 42 so that the capping device 30 may be lowered from a ship on a drill string (not shown) to mate with and engage stub 24 (FIG. 2). In one embodiment, it hydraulically engages in seals on the stub 24 using the connector 38. Particularly, an 18-¾ inch connector 18 (FIG. 2) in one embodiment may engage and hydraulically lock to an 18-¾ inch connector 38 (FIG. 3) on the capping device 30.

A three cavity blow-out preventer including cavities 34*a*, 34*b*, and 34*c* controls the passage of petroleum product through the center bore of the capping device 30 that communicates with the passage within the stub 24. The passage continues it's upwardly through the running tool 31. A frame 32 surrounds a blow-out preventer 4. Each blow-out preventer cavity includes an internal blind shear RAM 44 remotely controlled by bottle 36 in one embodiment. The hydraulic controls for the shear RAMS are entirely independent of any controls on the wellhead.

Thus, once the capping device 30 is sealed in place, the flow of petroleum product can be shut off by remotely operating the blind RAMs (not shown) within the blow-out preventers 34 to terminate the flow.

Thus, in some embodiments, the sequence is to first independently and remotely unlock the 18-¾" wellhead connector 18. Then the flexible lines 12 may be unlocked using the quick disconnect 14 including disconnects for kill and choke lines in some embodiments. Next, there may be an attempt to release the emergency disconnect 28 for the mux cables. Finally the device 20, which may be considered a lower marine riser package (LMRP), may be removed as shown in FIG. 2.

The overlying offshore platform picks up the capping device 30, that may be contained within an onboard backup conventional lower marine riser package or LMRP connected to a redundant mux cable. Then the capping device is run onto the drill pipe stub 24 and locked on to the open flowing top (using a remote operated vehicle or acoustic techniques), as shown in FIG. 3 in some embodiments. Finally the rig may move away from the wellhead 10 for the safety of workers.

Thereafter, the onboard LMRP may be used to drill a relief well. In one embodiment, a new drilling operation may be conducted through the capping device.

Thus in some embodiments it is possible to disconnect the riser above the blow-out preventer. While this may result in the free flow of petroleum products, it may preserve life and reduce injuries to workers on the platform. By using independently operated actuators, it is possible to remove the device 20 even when other protection systems have failed. This removal may be done using remotely operated vehicles, separate cables, an acoustic system or charged nitrogen bottles to activate a relief connection.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

providing an independently operable disconnect device that is remotely disconnectable from a lower marine riser package (LMRP) to reveal a riser profile compatible with a capping device connector, said device including connections to connect kill and choke lines to said package, said connections to automatically disconnect when said device is remotely disconnected from said package;

providing a capping device with a capping device connector to be coupled to said riser profile, said capping device including at least one blow-out preventer operable to stop the overflow of petroleum products from a well; and conducting a drilling operation through said capping device.

2. The method of claim 1 including enabling a drilling rig to remotely physically disconnect a riser from the LMRP.

3. The method of claim 1 including enabling said disconnect device to be mounted on the LMRP.

4. The method of claim 1 including providing independent hydraulic controls for said capping device.

5. The method of claim 4 including providing a plurality of remotely operated shear rams in said capping device.

* * * * *